United States Patent [19]

Smith

[11] 3,957,553

[45] May 18, 1976

[54] NON-CHROMATED ALKALINE ETCHING BATH AND ETCHING PROCESS FOR ALUMINUM

[75] Inventor: Harold Vernon Smith, Philadelphia, Pa.

[73] Assignee: Pennwalt Corporation, Philadelphia, Pa.

[22] Filed: Mar. 1, 1974

[21] Appl. No.: 447,430

Related U.S. Application Data

[63] Continuation-in-part of Ser. No. 278,891, Aug. 9, 1972, Pat. No. 3,802,973.

[52] U.S. Cl. ..... 156/22; 204/141.5; 252/79.5

[51] Int. Cl.[2] ..... C23F 1/00

[58] Field of Search ..... 156/22; 252/79.5; 204/129.75, 129.8, 141.5

[56] References Cited

UNITED STATES PATENTS

| | | | |
|---|---|---|---|
| 2,975,040 | 3/1961 | Elliott | 156/22 |
| 3,321,389 | 5/1967 | Anderson | 204/129.75 |
| 3,627,654 | 12/1971 | Petit et al. | 204/141.5 |
| 3,802,973 | 4/1974 | Smith | 252/79.5 |
| 3,810,797 | 5/1974 | Schaffstall et al. | 252/79.5 |

*Primary Examiner*—William A. Powell
*Assistant Examiner*—Brian J. Leitten
*Attorney, Agent, or Firm*—Robert G. Danehower

[57] ABSTRACT

Alkaline etching baths for aluminum are claimed in which oxidizing agents at low concentration replace chromates and fluorides in the control of galvanizing. Etching processes using these new baths are also disclosed and claimed.

9 Claims, No Drawings

NON-CHROMATED ALKALINE ETCHING BATH AND ETCHING PROCESS FOR ALUMINUM

BACKGROUND OF THE INVENTION

This invention is a continuation-in-part application of U.S. Ser. No. 278,891, filed Aug. 9, 1972, now U.S. Pat. No. 3,802,973 entitled "Aluminum Etching Process." In U.S. Ser. No. 278,891, now U.S. Pat. No. 3,802,973 certain oxidizing agents are used in alkali metal hydroxide solutions in the first stage of a dual etching process to produce an architectural finish on aluminum. I have now discovered that oxidizing agents when used at low concentrations will prevent the galvanizing effect from occurring during alkali etching of aluminum.

In the alkali etching of aluminum extrusions and sheets, industrial metal finishers are periodically troubled by the occurrence of an undesirable etch finish known as "galvanizing" or "galvanized etched finish." This undesirable and unpredictable etched finish may be described as displaying a highly reflective and grossly crystalline appearance. Often the galvanizing is so severe that the aluminum must be scrapped. In less severe cases, the aluminum must be mechanically polished before it can be reprocessed. Such losses and/or multiple processing contribute greatly to the cost of aluminum etching.

In U.S. Pat. No. 3,314,890 a process and bath compositions for the prevention of galvanizing in alkali etching of aluminum are disclosed. In this patent hexavalent chromium, fluoride ion and particular etching additives are effective in preventing galvanizing in alkaline etching baths at a temperature of 150°F. or lower. Recent ecological restrictions prevent the discharge into streams of effluents containing chromium and fluoride at concentrations exceeding a few parts per million. Since the processes for treating chromium and fluoride are quite expensive, the metal finishing industry has been looking for an inexpensive substitute. The oxidizing agents of my invention are used at very low concentrations and in addition have the advantage of being consumed by the etching so that no additional disposal problem is created when the bath is discharged.

DETAILED DESCRIPTION OF INVENTION

Alkaline etchant baths are extensively used in the aluminum finishing industry to improve the appearance of aluminum and to prepare aluminum surfaces for subsequent treatment. Any defective etching that may be produced by an alkaline etching bath detracts from that bath's productivity and usefulness, and adds to the costs of using that bath.

Studies of aluminum etching have indicated that extensive and continuous use of an alkaline etchant bath may produce a condition in the bath which favors production of defective etching. This condition is characterized by suspension of colloidal alloy metals in the bath, and by saturation of the bath with hydrogen. When said condition is obtained in the etchant bath, the bath tends to form a "galvanized etched finish" on aluminum being processed, develops an increased rate of attack on the aluminum, and exhibits an increased tendency to stain or unevenly etch aluminum surfaces.

The galvanizing effect will show up in the etching process after about 20 hours of continuous etching although there is no set time when galvanized etching will appear. I have also observed that when galvanized etching takes place, there will be about 60 grams or more of alumina dissolved in the etching solution. Amounts of dissolved alumina as high as 127 grams/liter have also been observed when galvanizing takes place.

I have now discovered an etching bath and etching process which by the addition of oxidizing agents prevents development of this galvanized condition, which decreases the occurrence of defective etching, and which permits continuous use of the etchant bath. In addition, the quality of etched finishes produced by an alkaline etchant bath is markedly improved by the addition of the oxidizing agents.

In the practice of this invention, a conventional chelated alkaline etchant bath is either continually or periodically treated with an oxidizing agent, or mixture of oxidizing agents. A small concentration of oxidizing agent — sufficient to be detected by qualitative analytical procedures — is maintained in the alkaline etchant bath at all times.

My new etching bath and etching process is applicable to either aluminum or aluminum alloys.

The aluminum metal should be carefully prepared for etching by first removing any cutting, rolling or stamping oils and greases. This is usually done by cleaning with an inhibited mild alkaline cleaner. The aluminum metal is then rinsed with water and then deoxidized by immersion or spray application in an inhibited acidic deoxidizer. Following another water rinse, the aluminum metal is ready for etching.

The class of alkali metal hydroxides is the source of alkali used in my etching bath and etching process. Sodium hydroxide or potassium hydroxide are equally suitable but sodium hydroxide is generally used since it is cheaper and more readily available.

The alkali metal hydroxide is used at a concentration of about 15 to about 200 gm/liter of water. A preferred concentration range of alkali metal hydroxide is from about 30 to about 75 gm/liter of water. Higher concentrations of alkali cause rapid depletion of the oxidizing agent.

In my etching solutions, chelating agents are useful for supressing alumina precipitation during etching. Among such chelating agents are sorbitol, gluconic acid, glucoheptonic acid, mannitol, ascorbic acid, sorbose, tannic acid, ethylenediamine tetraacetic acid, sodium chrom glucosate, diglycolic acid, picolinic acid, aspartic acid, dithiooxamide, d-gluconolactone, and l-rhamnose. These chelating agents are used at concentrations well known in the art and are generally within the range of about 0.5 to about 15 grams/liter.

Among the sources of oxidizing agents used in my etching solutions for etching aluminum or aluminum alloys are the following:

| | | |
|---|---|---|
| for persulfates | — | ammonium persulfate, sodium persulfate and potassium persulfate; |
| for peroxides | — | hydrogen peroxide and sodium peroxide; |
| for perborates | — | sodium perborate and potassium perborate, |
| for periodates | — | sodium periodate and potassium periodate; |
| for chlorites | — | sodium chlorite and potassium chlorite; |
| for chlorates | — | sodium chlorate, potassium chlorate and ammonium chlorate; |
| for perchlorates | — | sodium perchlorate, ammonium perchlorate |

-continued

| | | |
|---|---|---|
| | | and potassium perchlorate; |
| for iodates | — | sodium iodate, ammonium iodate and potassium iodate; |
| for hypochlorites | — | sodium, hypochlorite, potassium hypochlorite and calcium hypochlorite; |
| for nitrites | — | sodium nitrite, potassium nitrite and ammonium nitrite; |
| for bromates | — | potassium bromate, sodium bromate and ammonium bromate; |
| for peroxyphosphates | — | potassium peroxydiphosphate, sodium peroxydiphosphate and ammonium peroxydiphosphate; |
| for nitrates | — | sodium nitrate, potassium nitrate and ammonium nitrate. |

Mercury salts of the above are unsuitable because of ecological considerations. One or more of the oxidizing agents may be used at the same time.

In addition to the above solid compounds, oxygen and chlorine dioxide gases are suitable in the practice of my invention. Air is a very inefficient source of oxygen. I have also found that oxygen can be generated in the etching bath by making the aluminum work piece the anode. The cathode must be a separate compartment since the evolved hydrogen and oxygen must be separated.

In the practice of my invention, the alkali metal etching bath is either continually or periodically treated with one of the above oxidizing agents to maintain a small concentration of oxidizing agent, from about 0.0001 to about 1 gram per liter of etchant solution. A preferred concentration range of oxidant is from about 0.01 to about 0.1 gram/liter of etchant solution. At higher concentrations, the oxidizing agents produce an architectural-type of finish on the aluminum. The solid oxidizing agents can be added to the etching bath either as a powder or in aqueous solution.

The minimum concentration of oxidizing agent in my etching bath may be detected by the appearance of a purple color when a sample of the etching bath is acidified with hydrochloric or sulphuric acid and then a few drops of diphenylamine sulfonic acid are added. This minimum amount is about 0.0001 grams/liter.

The etching processes of my invention are usually performed by immersion of the work pieces in the etching solution contained in a steel tank. The tanks are equipped with coils for heating and/or cooling the etching bath. Agitation of the bath is desirable to maintain a uniform concentration of the etching solution, particularly at the interface with the work piece. Good ventilation is required to dispel the caustic fumes and by-product hydrogen gas.

Spraying of the work pieces with the etching solution is another way of practicing the invention.

The temperature of the etching solution may vary widely between the range of about 75° to about 190°F. A preferred temperature range is from about 140° to about 170°F. The preferred temperature range gives a good etching speed without producing excessive fumes at higher temperatures.

The time at which the work piece is in contact with the etching solution will vary with the condition of the work piece, that is, the extent of machining marks and other surface irregularities which are desired to be removed. An etching time of about 2 to about 15 minutes covers most of the conditions encountered. Most etching is done in about 3 to about 7 minutes and this is a preferred time range.

The oxidizing agent, either in a solid form as a granular or powdered material or as a liquid in aqueous solution can be combined with the sodium hydroxide and chelating compound. A typical solid concentrate would be alkali metal hydroxide — 95 percent, chelating agent — 4 percent and oxidizing agent — 1 percent. Another solid concentrate would be sodium hydroxide—97.9 percent, sorbitol—2 percent and sodium perborate—0.1 percent.

The alkali metal hydroxide can also be supplied as an aqueous concentrate in which the chelating compound and the oxidizing compound can be dissolved therein.

Alkali metal hydroxide, chelating compound and oxidizing compound are the essential ingredients in my new etching baths and etching processes. However, other additives are compatible in my etching bath, such as, detergents to improve rinsing, to provide a foam blanket on the bath, or to extend the bath life. Brightening additives to increase the reflectivity if desired and fluorides to increase the grain size.

Examples of surfactants used in alkaline etching baths are shown in U.S. Pat. No. 3,557,000. A common brightener additive is sodium nitrate in high concentrations as shown in U.S. Pat. No. 2,673,143. The use of fluorides in alkaline etching solutions is shown in U.S. Pat. No. 3,314,890.

The best mode of practicing my invention will be apparent from consideration of the following examples.

EXAMPLE 1

An alkaline etchant bath comprised of sodium hydroxide and sorbitol chelating compound was continuously used to etch sections of aluminum. During this period of use, the bath was regularly analyzed and fresh etchant (97 percent sodium hydroxide and 3 percent sorbitol) was regularly added so that the concentration of "free" or unreacted sodium hydroxide was maintained close to 45 gm/liter at all times.

After about 36 hours of continuous operation, the concentration of aluminum dissolved in the bath was 115.63 gm/liter. The bath was tested at this point for oxidant using diphenyl aminesulfonic acid indicator. No oxidant was found.

The extrusion was prepared for etching by immersion in an inhibited, mild alkaline cleaner solution for 10 minutes at 165°F., rinsing in cold water, immersion in an inhibited, acidic deoxidizer solution for 2 minutes at 80°F., and finally rinsing with water. The cleaned and deoxidized section of 6063 alloy aluminium extrusion was then etched for 5 minutes in the bath described above. Bath temperature was held at 160°F±1°F. during this etching.

The etched surface produced by this treatment was shiny, silver colored, had fair hide of surface defects and was completely covered by fine grained "galvanized etch." At this point chlorine dioxide gas was introduced to the bath until a concentration of 0.05 gm $ClO_2$/liter was obtained.

Another section of 6063 aluminum extrusion was etched in this bath for 5 minutes at 160°F. The etched surface produced by this treatment showed less "galvanized etch" — approximately 75 percent of the extrusion's surface compared to 100 percent on the previous section.

Chlorine dioxide was again added to the bath, to increase $ClO_2$ concentration to 0.10 gm/liter. A third section of aluminum extrusion was etched in this bath for 5 minutes at 160°F. The "galvanized etch" covered only 50 percent of the extrusion's surface.

The chlorine dioxide concentration in the above bath was increased to 0.125 gm/liter and a fourth section of the same aluminum extrusion was etched in this bath for 5 minutes at 160°F. The etched surface produced by this bath showed no "galvanized etch."

EXAMPLE 2

In another etchant bath using sodium hydroxide etchant at 45 gm/liter and sorbitol chelating compound at 4.35 gm/liter after 24 hours of operation, analysis of the bath showed 60.0 gm/liter of dissolved aluminum. Analysis of the bath for oxidant was negative. A section of 6063 aluminum alloy extrusion was cleaned and deoxidized as in Example 1 and was then etched for 5 minutes in the above solution at 160°±1°F. The etched finish produced was shiny, silvery colored, has fair hide of surface defects — and was completely covered by fine grained "galvanized etch."

At this time 0.05 gm/liter of ammonium persulfate $(NH_4)_2S_2O_8$ was added to the bath. Another section of 6063 aluminum extrusion prepared as above was etched in the bath for 5 minutes at 160°F. The alumina surface produced by this etching was free of the "galvanized etch."

EXAMPLE 3

Another chelated etchant bath was continuously used until its concentration of dissolved aluminum was 86.5 gm/liter after about 30 hours of operation. The concentration of "free" etchant was maintained close to 45 gm/liter of NaOH during this use. Analysis of the bath indicated no oxidant was present at this point.

A section of 6063 alloy extrusion cleaned and deoxidized as in Example 1 was etched in the above solution for 5 minutes at 160°F±1°F. The etched surface so produced was shiny, silver colored, had good hide of surface defects but was completely covered by "galvanized etch."

Etching was then discontinued and the bath was vigorously aerated for 36 hours. The bath temperature was maintained at 110°–140°F, during aeration.

Another section of the same aluminum extrusion prepared as above was etched in the aerated solution for 5 minutes at 160°F.

The etched surface produced by the aerated bath was frosty, slightly white in color, had good hide of surface defects and was free of "galvanized etch."

EXAMPLE 4

An etchant bath was prepared with sodium hydroxide and sorbitol. After this bath had been used continuously to etch aluminum, for about 36 hours, analysis of the bath revealed -

| | | |
|---|---|---|
| Unreacted alkali | — | 90.0 gm/liter |
| Dissolved aluminum | — | 63.22 gm/liter |
| Oxidant | — | none |

A section of 6063 alloy aluminum extrusion was prepared (as described in Example 1) and then treated in above etchant bath for 6 minutes at 130°F. The surface produced on the aluminum by this etching was slightly frosty, silver colored, had good hide of surface defects and was completely covered with coarse grained "galvanized etch."

0.01 gm/liter of sodium perborate was added to the above etchant bath.

Within about 5 minutes another section of the same extrusion was prepared and then treated in etchant bath for 6 minutes at 130°F. The aluminum surface produced by this etching has no "galvanized etch."

EXAMPLE 5

An etchant bath was prepared by dissolving 56.94 gm/liter of potassium hydroxide, 3.0 gm/liter of gluconic acid and 0.06 gm/liter of molybdenum trioxide in water. This bath was used continuously, for a period of about 20 hours, to etch sections of 6063 alloy aluminum extrusions.

During this period of use, the concentration of unreacted alkali was maintained close to 60 gm/liter by regular additions of a liquid etchant concentrate which was composed of

| | % By Weight |
|---|---|
| Potassium Hydroxide, 45% soln. | 94.9 |
| Gluconic Acid, 50% soln. | 5.0 |
| Molybdenum Trioxide, crystal | 0.1 |

After about 20 hours of continuous use, analysis of the bath revealed

| | | |
|---|---|---|
| Unreacted alkali | — | 60.80 gm/liter |
| Dissolved aluminum | — | 65.85 gm/liter |
| Oxidant | — | trace detected |

(Faint purple color —diphenyl amine sulfonic acid indicator)

A section of 6063 alloy aluminium extrusion was prepared (as described in Example 1) and then treated in above etchant bath for 5 minutes at 160°F. The surface produced by this etching was frosty, white, had good hide of surface defects and had no "galvanized etch."

EXAMPLE 6

An etchant bath was prepared with sodium hydroxide and sorbitol. This bath was used continuously, for a period of about 48 hours, to etch sections of 6063 alloy aluminum extrusion. During this period of use, the concentration of unreacted alkali was maintained close to 45 gm/liter by regular additions of a powdered etchant concentrate which was composed of

| | % by Weight |
|---|---|
| Sodium hydroxide, crystal | 97.0 |
| Sorbitol, powder | 3.0 |

After about 48 hours of continuous use, analysis of the bath revealed

| | | |
|---|---|---|
| Unreacted alkali | — | 45.44 gm/liter |
| Dissolved aluminum | — | 84.70 gm/liter |
| Oxidant | — | none |

A section of 6063 alloy aluminum extrusion was prepared (as described in Example 1) and then treated in above etchant bath for 5 minutes at 160°F. The surface produced on the aluminum by this etching was slightly shiny, silver colored, had good hide of surface defects and was completely covered with fine grained "galvanized etch."

Another section of the same extrusion was prepared and then suspended, by means of an aluminum clamp in above etchant bath. The aluminum was immediately connected to the 'anode' terminal of a D.C. rectifier and the steel wool of the etchant tank was connected to the "cathode" terminal of the rectifier. A potential of 5 volts was applied as the aluminum was etched for 5 minutes at 160°F.

During this electrolysis, some oxygen was visible on the aluminum surface, and hydrogen was visible on the steel tankwall.

The surface produced on the aluminum by this treatment was shiny, silver colored, had good hide of surface defects and had no "galvanized etch."

EXAMPLE 7

Sections of various aluminum alloys were prepared (as described in Example 1) and then etched as follows

| Etchant Bath Composition | |
|---|---|
| Unreacted sodium hydroxide | 41.65 gm/liter |
| Sodium Gluconate | 3.35 gm/liter |
| Dissolved Aluminum | 126.90 gm/liter |
| Potassium Persulfate | 0.001 gm/liter |

| ALLOY | ETCHING TIME | ETCHING TEMPERATURE | OBSERVATIONS OF ETCHED SURFACE |
|---|---|---|---|
| 2024-T3 sheet | 3 minutes | 140°F. | Shiny, silver color, good hide of surface defects no "galvanize" |
| 5052-0 sheet | 10 minutes | 130°F. | Frosty, white color, good hide of surface defects, no "galvanize" |
| 6061-T6 rod | 2 minutes | 140°F. | Frosty, white color, fair hide of surface defects, no "galvanize" |
| 6063-T5 extrusion | 5 minutes | 160°F. | Shiny, silver color, good hide of surface defects, no "galvanize" |
| 7075-T6 sheet | 5 minutes | 150°F. | Shiny, slightly white, good hide of surface defects, no "galvanize" |

EXAMPLE 8

An etchant bath was prepared by dissolving 57.0 gm/liter of sodium hydroxide and 3.0 gm/liter of sodium gluconate in water. To this bath was added 2.0 gm/liter of a powdered etchant A bath additive described below. The resultant bath was used continuously, for a period of about 24 hours, to etch sections of 5052 alloy aluminum sheet.

During this period of use, the concentration of unreacted alkali was maintained close to 60.0 gm/liter by regular additions of a powdered etchant concentrate which was composed of

| | % by Weight |
|---|---|
| Sodium hydroxide, crystal | 95.0 |
| Sodium Gluconate, powder | 5.0 |

and the concentration of etchant additive was maintained close to 2.0 gm/liter by regular additions of a powdered etchant bath additive A which was composed of

"A"

| | % by Weight |
|---|---|
| Borax, decahydrate | 78.0 |
| Sodium Gluconate, powder | 20.0 |
| Sodium Perborate, monohydrate | 2.0 |

After about 24 hours of continuous use, analysis of the bath revealed

| | | |
|---|---|---|
| Unreacted alkali | — | 59.55 gm/liter |
| Etchant bath additive | — | 2.10 gm/liter |
| Dissolved aluminum | — | 62.37 gm/liter |
| Oxidant | — | Positive test (faint purple color) |

A section of 5052 alloy aluminum sheet was prepared (as described in Example 1) and then treated in above bath for 10 minutes at 130°F. The surface produced by this etching was frosty, white, had good hide or surface defects and had no "galvanized etch."

EXAMPLE 9

An etchant bath was prepared by dissolving 72.735 gm/liter of sodium hydroxide, 2.250 gm/liter of sodium gluocoheptonate and 0.015 gm/liter of sodium peroxide in water. The resultant bath was used continuously, for a period of about 48 hours, to etch sections of 5005 alloy aluminum sheet. This etching was carried out in an etching machine which caused the etchant bath to be sprayed, at a pressure of about 15 psi, onto the aluminum sections. Temperature of the etchant bath was maintained at 140° ± 2°F.

During this period of use, the concentration of unreacted alkali was maintained close to 75.0 gm/liter by regular additions of a powdered etchant concentrate which was composed of

| | % By Weight |
|---|---|
| Sodium Hydroxide, crystal | 96.98 |
| Sodium Glucoheptonate, crystal | 3.00 |
| Sodium Peroxide, powder | 0.02 |

After about 48 hours of continuous use, analysis of the bath revealed

| | | |
|---|---|---|
| Unreacted alkali | — | 73.06 gm/liter |
| Dissolved aluminum | — | 54.91 gm/liter |
| Oxidant | — | Trace detected |

A section of 5005 alloy aluminum sheet was prepared (as described in Example 1) and then spray-etched in above bath for 1.0 minute at 140°F., using a spray pressure of about 15 psi. The surface produced by this etching was frosty, white, very uniform in appearance, had no "galvanized etch."

EXAMPLE 10

An etchant bath was prepared by dissolving 28.5 gm/liter of sodium hydroxide and 1.5 gm/liter of sorbitol in water. This bath was used continuously, for a period of about 96 hours, to etch sections of 6063 alloy aluminum extrusion. During this period of use, the concentration of unreacted alkali was maintained close to 30 gm/liter by regular additions of a powdered etchant concentrate which was composed of

| | % by Weight |
|---|---|
| Sodium Hydroxide, crystal | 95.0 |
| Sorbitol, powder | 5.0 |

After about 96 hours of continuous use, analysis of the bath revealed

| | | |
|---|---|---|
| Unreacted alkali | — | 29.88 gm/liter |
| Dissolved aluminum | — | 141.95 gm/liter |
| Oxidant | — | none |

A section of 6063 alloy aluminum extrusion was prepared (as described in Example 1) and then treated in above etchant bath for 7 minutes at 150°F. The surface produced on the aluminum by this etching treatment was slightly frosty, slightly white in color, had good hide of surface defects and was completely covered by coarse grained "galvanized etch."

The etchant bath (4 liters) was then treated with oxygen. Dry, clean oxygen gas was introduced into the bottom of the bath through a stainless steel tube. A flow of 200 cc/minute of oxygen was maintained for a period of 15 minutes. During this oxygenation, temperature of the bath was maintained at 150° ± 2°F.

Another section of the same extrusion was prepared and then treated in above etchant bath (immediately after oxygenation had been discontinued) for 7 minutes at 150°F. The surface produced on the aluminum by this etching was frosty, white, had very good hide of surface defects and had no "galvanized etch."

I claim:

1. The composition for etching aluminum and aluminum alloys comprised of an aqueous solution of alkali metal hydroxide — 15 to about 200 grams/liter, at least one chelating agent — 0.5 to about 15 grams/liter, and at least one oxidizing agent — 0.0001 to about 1 gram/liter.

2. The composition of claim 1 in which the oxidizing agent is selected from the group consisting of nitrites, persulfates, chlorites, peroxyphosphates, chlorates, perchlorates, peroxides, iodates, hypochlorites, perborates, periodates, bromates, nitrates, oxygen and chlorine dioxide.

3. The composition of claim 1 in which the alkali metal hydroxide concentration is from about 30 to about 75 grams/liter.

4. The process for etching aluminum and aluminum alloys comprising contacting the said aluminum with an aqueous solution of alkali metal hydroxide — 15 to about 200 grams/liter, at least one chelating agent — 0.5 to about 15 grams/liter, and at least one oxidizing agent — 0.0001 to about 1 gram/liter for 1 to 15 minutes at a temperature within the range of 120° to 190°F.

5. The process of claim 4 in which the oxidizing agent is selected from the group consisting of nitrites, persulfates, chlorites, peroxyphosphates, chlorates, perchlorates, peroxides, iodates, hypochlorites, perborates, periodates, bromates, nitrates, oxygen and chlorine dioxide.

6. The process of claim 4 in which the concentration of alkali metal hydroxide is about 30 to about 75 grams/liter.

7. The process for etching aluminum and aluminum alloys comprising immersing the said aluminum in an etching tank containing an aqueous solution of alkali metal hydroxide — 15 to about 200 grams/liter at least one chelating agent — 0.5 to about 15 grams/liter, and at least one oxidizing agent — 0.0001 to about 1 gram/liter for 1 to 15 minutes at a temperature within the range of 120° to 190°F.

8. The process of claim 7 in which the oxidizing agent is oxygen.

9. The process of claim 8 in which the oxygen is generated by electrolysis of the etching solution using the aluminum being etched as the anode.

* * * * *